United States Patent [19]

Keating, Jr.

[11] 4,083,455

[45] Apr. 11, 1978

[54] RECLOSABLE CARTON AND BLANK THEREFOR

[75] Inventor: Martin Keating, Jr., Park Ridge, N.J.

[73] Assignee: Universal Folding Box Co., Inc., Hokoben, N.J.

[21] Appl. No.: 778,041

[22] Filed: Mar. 16, 1977

[51] Int. Cl.[2] ..... B65D 5/66

[52] U.S. Cl. ..... 206/625; 229/44 CB

[58] Field of Search ..... 229/51 TC, 45, 37, 44 CB; 206/625, 626

[56] References Cited

U.S. PATENT DOCUMENTS

| | | | |
|---|---|---|---|
| 1,234,483 | 7/1917 | Luke | 229/51 TC UX |
| 3,294,309 | 12/1966 | Coe | 229/45 |
| 3,295,742 | 1/1967 | Coe | 229/45 |
| 3,353,740 | 11/1967 | Outwater | 229/51 TC |
| 3,523,636 | 8/1970 | Phillips, Jr. | 229/51 TC |
| 3,595,466 | 7/1971 | Rosenburg, Jr. | 229/51 TC |
| 3,608,812 | 9/1971 | Hamilton | 229/37 R |
| 3,893,614 | 7/1975 | Meyers | 229/51 TC |

*Primary Examiner*—Davis T. Moorhead

*Attorney, Agent, or Firm*—James & Franklin

[57] ABSTRACT

A blank, and a reclosable carton made from the blank, include a receptacle portion and a cover portion which may be pivoted to overlap and close the otherwise open top of the receptacle portion. The cover portion comprises a pair of opposed side cover panels, each in turn comprising a first panel portion connected to and depending from a top cover panel, and a second locking panel portion connected to the first panel portion by a line of severance. Each of the second locking panel portions overlays and is adhered to an associated side panel of the receptacle portion, the cover portion being adhered to the receptacle portion exclusively by the second locking panel portions. The carton thus formed uses less paperboard and less glue than the known reclosable cartons and is also easier to open initially.

10 Claims, 7 Drawing Figures

RECLOSABLE CARTON AND BLANK THEREFOR

BACKGROUND OF THE INVENTION

The present invention relates to blanks and reclosable cartons formed therefrom, and more particularly to such blanks and cartons having a receptacle portion and a cover portion which may be pivoted relative to the receptacle portion to overlap the upper edges of the receptacle portion and close the otherwise open top thereof.

U.S. Pat. No. Re. 26,471 describes a reclosable carton having a receptacle portion and a cover portion having downwardly extending skirt portions which overlap the carton receptacle portion when the carton is closed. In the carton disclosed therein the front of the cover portion and the front of the receptacle portion are adhered together (for example, by an adhesive) by means of a front flap, so that, to initially open the carton, the front cover portion must be torn from the front receptacle portion along a designated line of severance on the flap. While cartons of this type are generally acceptable for their purpose, they have not proven to be entirely satisfactory. For example, the consumer-user attempting to initially open the carton will generally grasp the cover portion by the front thereof, closely adjacent the point at which the covered portion is adhered to the receptacle portion, immobilize the receptacle portion and pry the front cover portion upwardly. As a result, the user has little leverage to employ in attempting to tear the front cover portion from the front receptacle portion. In the case of children and infirm adults (for example, those with arthritic hands), initial opening of the carton may be difficult, if not impossible. Also, while the carton design contemplates that there be a flap secured to the front panel of the receptacle portion by a line of weakness (i.e., a line of severance such as a perforation line) and adhered to the front panel of the cover portion by glue or other adhesive, the adhesive applied for this purpose may accidentally be applied to unintended areas with the result that the front cover panel is secured directly to the front receptacle panel (not via the flap) without any intervening line of weakness. In this case, the absence of any intervening line of weakness precludes relatively easy initial opening of the carton and the carton must be forced open by tearing of the front cover panel, the front receptacle panel, or both.

Furthermore, the provision of a front flap secured to the front receptacle panel and adhered to the front cover panel requires the use of additional amounts of paperboard (or other material from which the carton is made) and glue, thus increasing manufacturing cost. Finally, the presence of the front flap intermediate the front cover panel and front receptacle panel tends to cause the front receptacle panel to bow inwardly to accommodate the extra paperboard thickness, thus posing problems when the carton is subsequently used in connection with automatic packaging machinery.

Accordingly, it is an object of the present invention to provide a reclosable carton which is consistently easier to originally open then the known reclosable cartons.

Another object is to provide such a reclosable carton which employs lesser amounts of paperboard and glue then the known reclosable cartons.

A further object is to provide such a reclosable carton in which the front receptacle panel remains relatively planar, thus facilitating handling of the carton by automatic packaging machinery.

It is also an object of the present invention to provide such a reclosable carton which is easier to open because the consumer-user is afforded more leverage in initially opening the carton.

It is another object to provide such a reclosable carton which is consistently easy to open because the possibility of misapplied glue accidently adhereing the front cover panel directly to the front receptacle panel is substantially eliminated.

It is a further object to provide a suitably cut and scored blank useful in the manufacture of such a reclosable carton.

SUMMARY OF THE INVENTION

It has now been found that the above and related objects of the present invention are obtained in a reclosable carton in which the cover portion is adhered to the receptacle portion exclusively by side cover panels.

Generally speaking, a reclosable carton is formed of a suitably cut and scored blank having a receptacle portion and a cover portion which is pivotally mounted on the receptacle portion and is movable to overlap the upper edges of the receptacle portion and close the otherwise open top thereof. The receptacle portion comprises connected front, rear, bottom and a pair of opposed side receptacle panels. The cover portion comprises a top cover panel hingedly connected to the upper edge of the rear receptacle panel, a pair of opposed side cover panels, and a front cover panel. The side and front cover panels are connected to the top cover panel and form skirt portions parallel and adjacent to the respective underlying receptacle panels. Each of the side cover panels comprises a first panel portion connected to and depending from the top cover panel, and a second locking panel portion connected to the first panel portion by a line of severance. Each of the second locking panel portions overlays and is adhered (for example, by glue or adhesive) to an associated one of the side receptacle panels, with the cover portion being adhered to the receptacle portion exclusively by such second locking panel portions. The front receptacle panel includes at the top thereof a horizontally spaced pair of downwardly extending tabs overlying areas of the front surface thereof. The inner surface of the front cover panel defines upwardly facing ledges engaging the downwardly extending ends of the tabs when the cover portion is telescoped over the receptacle portion to close the latter. The tab/ledge engagement serves to maintain the cover in the closed portion after its initial opening and subsequently closing.

In a preferred embodiment, the second locking panel is connected to the remainder of the cover portion only by the aforesaid line of severance, which line of severance in turn preferably intersects the rear edge of the second locking panel at or below the junction of the top of the top cover panel and the rear receptacle panel. Preferably each of the second locking panel portions has the general configuration of a right triangle and is detachably connected to its associated first panel portion only by the edge corresponding to the hypotenuse of the right triangle. The placement of the line of severance away from the front of the package enables the consumer-user to employ greater leverage in initially opening the closed carton.

Elimination of the prior art front flap not only reduces the amount of paperboard required to manufacture the carton, but also reduces the possibility of misapplied glue accidentally sealing the front cover panel to the front receptacle panel. Indeed, as the combined area of the second locking portions of the side cover panels is preferably considerably less than the area of the front flap, less glue is required to form the package. Furthermore, the elimination of a front flap disposed intermediate the front cover panel and the front receptacle panel reduces the tendency of the front receptacle panel to buckle inwardly and thus renders the carton better adapted for automatic packaging machines such as carton fillers.

Another aspect of the present invention comprises a suitably cut and scored blank for forming the aforesaid carton. The blank comprises a receptacle portion having a front panel, a rear panel, side panels, a bottom closure panel, and a horizontally spaced pair of tabs extending from a top edge of the front receptacle panel. The blank further comprises a cover portion comprising a top panel connected to the top edge of the rear receptacle panel, a front panel connected to the top edge of the top cover panel, a pair of side panels, and flaps extending from the top edge of the side cover panels. Each of the side cover panels is connected along one of its side edges to a side edge of the top cover panel, and the flaps are adapted to be adhered behind the front cover panel and spaced from the top cover panel and each other to engage the tabs. Each of the side cover panels has a readily severable line of weakness dividing the respective side cover panel into detachably connected front and rear segments. The front segment is connected along one of its edges to the front cover panel, and the rear segment is adapted to be adhered to an adjacent one of the side receptacle panels.

In a preferred embodiment, the rear segment is connected to the remainder of the cover portion only by the line of weakness, and the line of weakness intersects the rear edge of the rear segment at a point coincident with or outwardly spaced from the junction of the top cover panel and the rear receptacle panel.

DETAILED DESCRIPTION OF THE PREFERRED EMBODIMENTS

Figure 1:
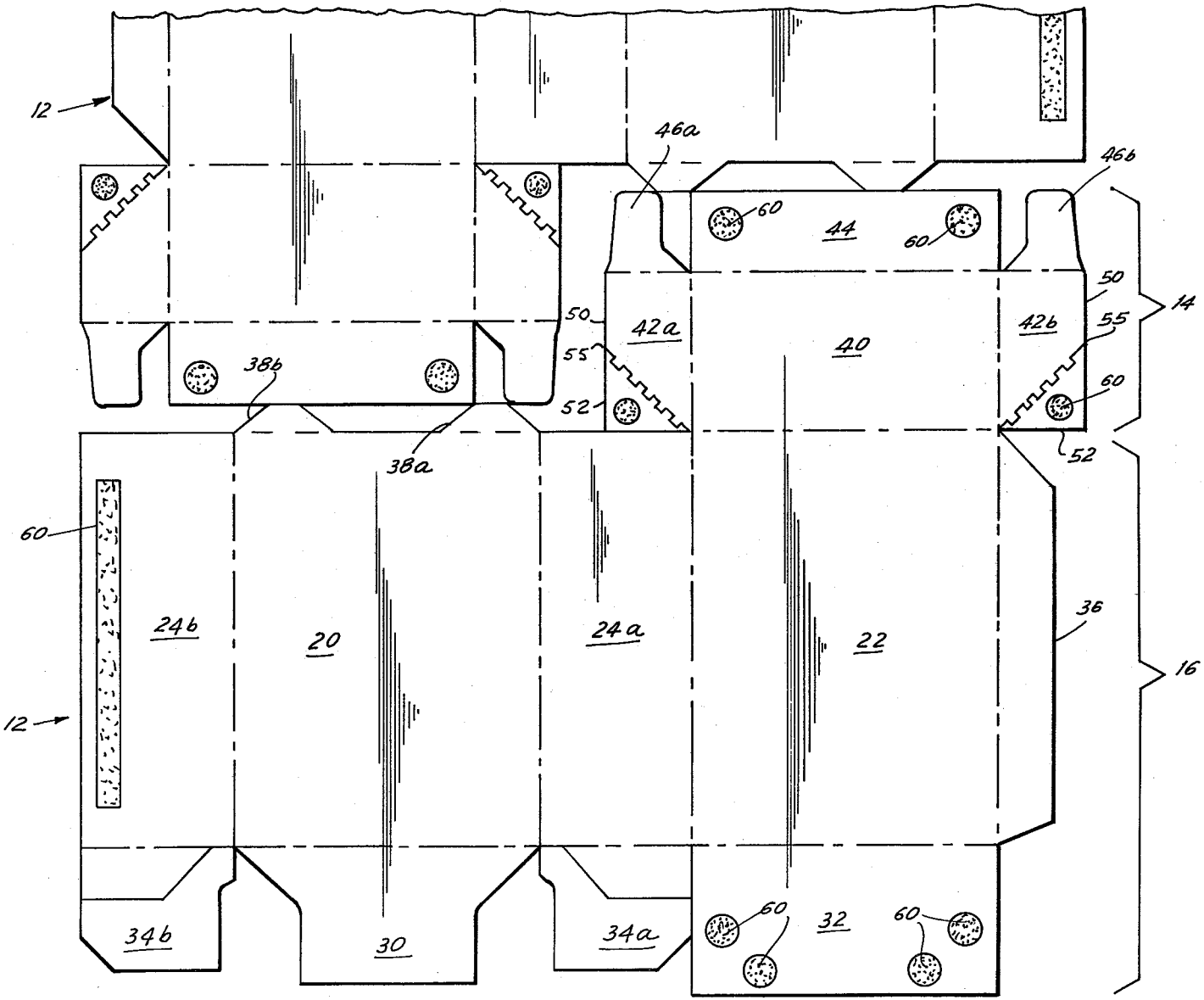
FIG. 1 is a fragmentary top plan view of a pair of blanks according to the present invention.
Figure 2:
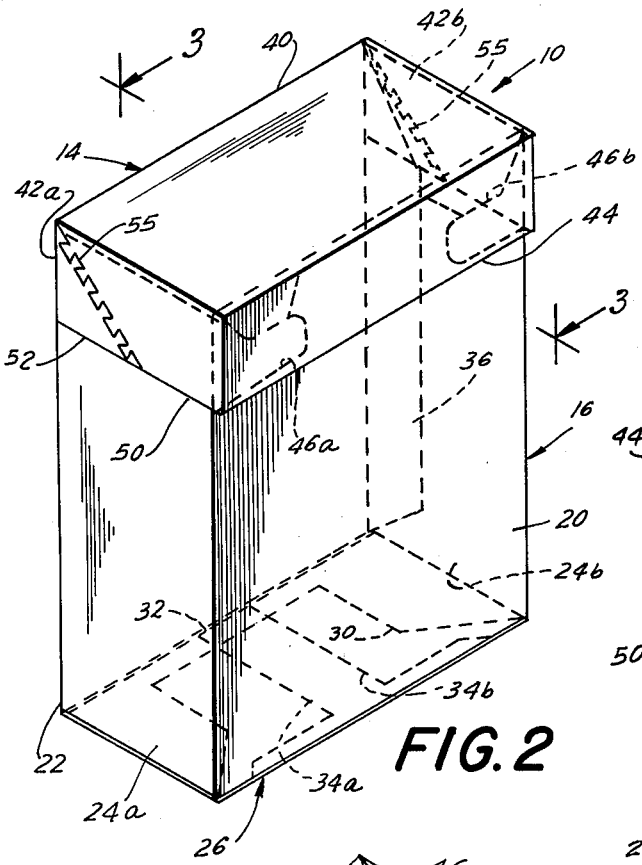
FIG. 2 is an isometric view of a reclosable carton according to the present invention.
Figure 3:
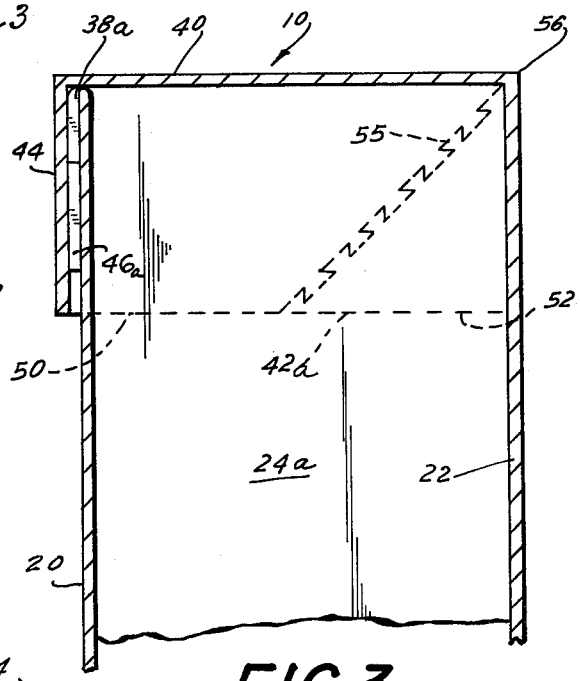
FIG. 3 is a fragmentary sectional view, to a slightly enlarged scale, taken along the line 3—3 of FIG. 2.
Figure 4:
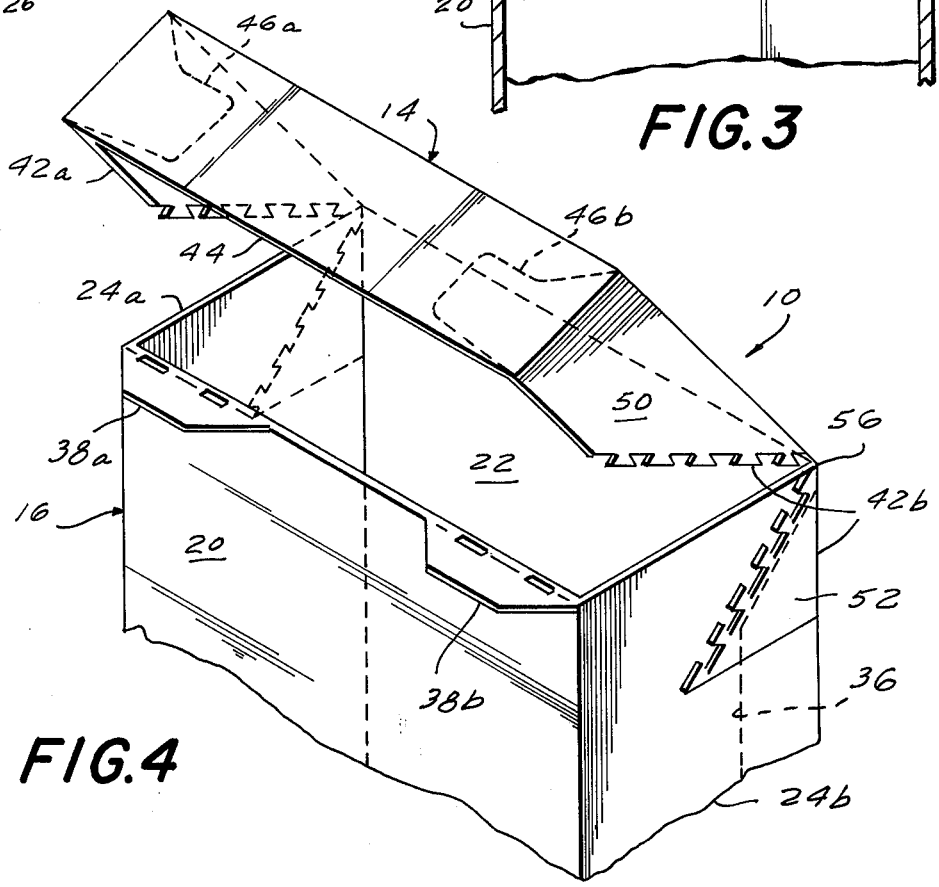
FIG. 4 is a fragmentary isometric view of the carton of FIG. 2, to a slightly enlarged scale, showing the cover portion after initial opening of the carton.

Referring now to the drawings, a carton generally designated 10 and made according to the present invention is shown in FIGS. 2–4, and one and part of a second suitably cut and scored blank 12 from which a pair of cartons 10 may be formed are shown in FIG. 1 as they might be arranged on a paperboard sheet. The carton 10 comprises a cover portion generally designated 14 and a receptacle portion generally designated 16, the cover portion 14 being adapted to pivot from the position shown in FIG. 4, where it exposes the open top of the receptacle portion 16 to the position shown in FIG. 2 where it overlaps the upper edges of the receptacle portion 16 and closes the otherwise open top thereof.

More particularly, the receptacle portion 16 comprises a plurality of hingedly connected portions as follows: a front panel 20, a rear panel 22, a pair of opposed side panels **24*a* and 24*b*, and a bottom generally designated 26 (see FIG. 2). The receptacle bottom 26 is in turn comprised of a front bottom panel 30, a rear bottom panel 32, and a pair of side bottom flaps 34*a* and 34*b* these elements being hingedly connected to and depending from front receptacle panel 20, rear receptacle panel 22 and side receptacle panels 24*a* and 24*b*, respectively. The bottom 26 is formed in a conventional manner with panel 30 being disposed intermediate rear bottom panel 32 (which forms the base for the carton 10) and side bottom flaps 34*a* and 34*b***.

The receptacle portion 16 additionally comprises a narrow lip 36, hingedly connected to rear receptacle panel 22 and adhered to side receptacle panel **24*b* to initially maintain the carton in its rectangular configuration. The receptacle portion 16 further includes a pair of horizontally spaced tabs 38*a* and 38*b* which are hingedly connected to the upper edge of front receptacle panel 20 and bent forwardly and downwardly therefrom so as to overlie a portion of the front surface thereof. To facilitate their being bent forwardly and downwardly tabs 38*a* and 38*b* are preferably connected to the upper edge of front receptacle panel 20** by a line of weakness such as a perforated line.

The cover portion 14 comprises a top cover panel 40 hingedly connected to the upper edge of the rear receptacle panel 22, a pair of opposed side cover panels **42*a* and 42*b* and a front cover panel 44, the side cover panels 42*a* and 42*b* and the front cover panel 44 being hingedly connected to and depending from the sides and front of the top cover panel 40, respectively, and forming skirt portions parallel and adjacent to the respective underlying receptacle panels 24*a*, 24*b* and 20. Flaps 46*a* and 46*b* are hingedly connected to the forward edge of the side cover panels 42*a* and 42*b*, respectively, and adhered to opposite ends of the front cover panel 44 in such a manner as to form ledges on the inner surface of the front cover panel 44. The flaps 46*a* and 46*b* are so configured and dimensioned that the tops thereof are spaced from the top of the front cover panel 44 by a distance sufficient to permit their engagement by the downwardly extending ends of the tabs 38*a* and 38*b*, respectively, when the cover portion 14 is pivoted over the receptacle portion 16 to its FIG. 2 position to close the latter. It will be noted that the engagement of tabs 38 and ledges 46 serves to secure the cover portion 14 in a position closing the receptacle portion 16** both initially (before opening of the carton) and thereafter (once the carton has been initially opened and then reclosed).

Each side cover panel 42 is in turn comprised of a first panel portion 50 hingedly connected to and depending from the top cover panel 40 and a second or locking panel portion 52 connected to the first panel portion by a line of severance 55 (such as a perforated line). Each of the second or locking panel portions 52 overlies and is adhered to an associated one of the side receptacle panels 24. It is an essential feature of the present invention that the cover portion 14 is adhered (i.e., glued) to the receptacle portion 16 exclusively by means of the locking panel portions 52. It will be noted that the locking panel portions 52 are connected to the remainder of the cover portion 14 only by the lines of severance 55.

This is accomplished by having each line of severance 55 intersect the rear edge of the locking panel portion 52 at or below the level of the junction of the top cover panel 40 and the rear receptacle panel 22. Preferably each locking panel portion 52 has the configuration of a right triangle and is detachably connected to its associated first panel portion 50 only at the edge of the locking panel portion 52 corresponding to the hypotenuse of the right triangle. The first panel portion 50 and locking panel portion 52 comprise the front and rear segments of each side cover panel 42.

The carton 10 may be conveniently and rapidly formed from the blank 12 in the following manner. Adhesive means suitable for paperboard are applied in areas 60 of the side receptacle panel 24*b*, rear bottom flap 32 and front cover panel 44. The blank 12 is manipulated into the shape of an open carton 12 with lip 36 being overlayed by the adhesive area 60 of side receptacle panel 24*b*, the bottom side and front flaps 34*a*, 34*b* and 30 being overlayed by the adhesive areas 60 of bottom panel 32, and the front side flaps 46*a* and 46*b* being overlayed by the adhesive areas 60 of front cover panel 44.

Once the receptacle portion 16 has been filled with its final contents, the cover portion 14 is pivoted downwardly to its closed position in which the front cover panel 44 and the side cover panels 42 overlie the upper edges of the receptacle front cover 20 and side receptacle panels 24, respectively. The closing action forces the tabs 38 forwardly and downwardly until they rest intermediate the tops of the front cover flaps 46 and the bottom of the top cover panel 40. The adhesive areas 60 of the locking panel portions 52 are then pressed against the underlying side receptacle panels 24 to seal the carton.

To open the carton the receptacle portion 16 is immobilized and the front cover flap 44 is pried upwardly. When the carton is being opened for the first time, this action forces the first and second panel portions 50 and 52 of each side cover panel 42 to separate along the line of severance 55, this being accomplishable with no strenuous exertion due to the fact that the lines of severance 55 are relatively remote from the front cover panel 44 and the advantage of leverage is thus obtained. Whether the carton is being initially opened or reopened (after an initial opening), the prying action includes a generally forwardly directed component which enables the front cover flaps 46 to be displaced forwardly of the tabs 38 so that the front cover flaps 46 easily pass over the tabs 38. When the cover portion 14 is returned to its original position on the receptacle portion 16 and the front cover panel 44 is released, the tabs 38 once again engage the front cover flaps 46 to maintain the carton 10 in its closed configuration.

Figure 5:
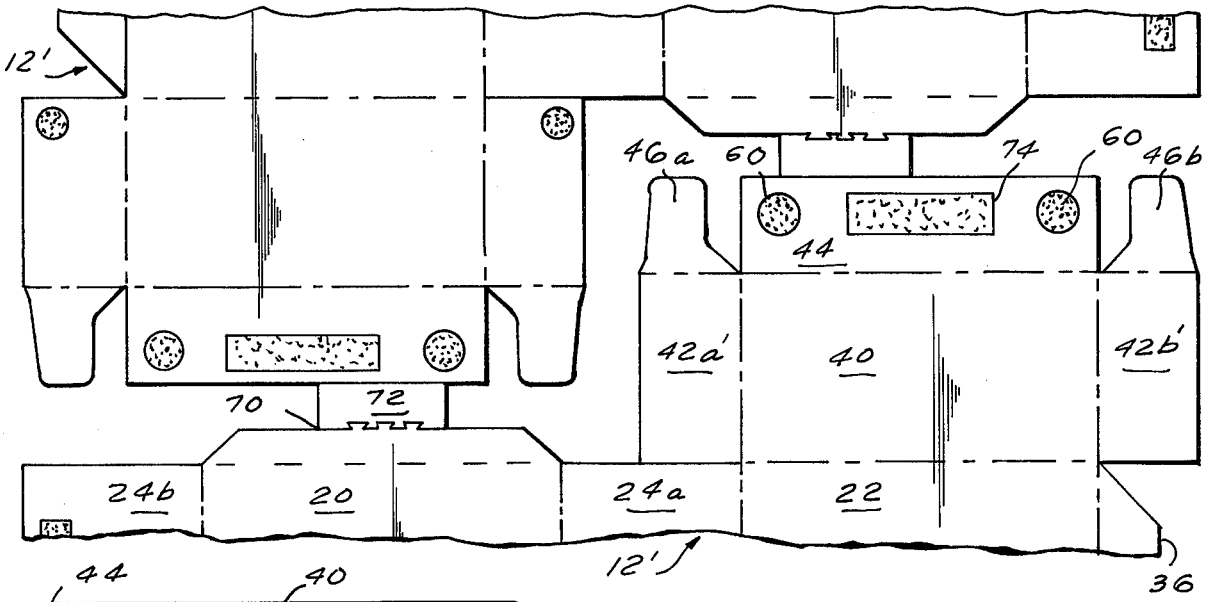
FIGS. 5, 6 and 7 are views similar to FIGS. 1, 3 and 4, respectively, but showing blanks and cartons of the prior art for comparative purposes.
Figure 6:
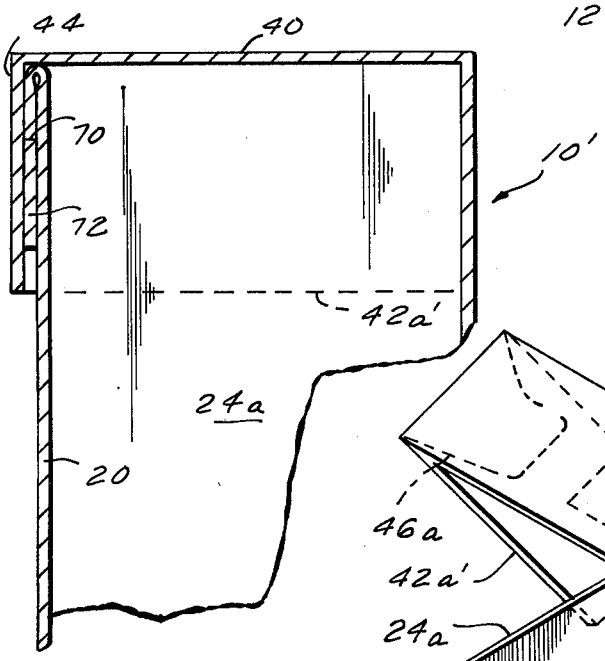
Figure 7:
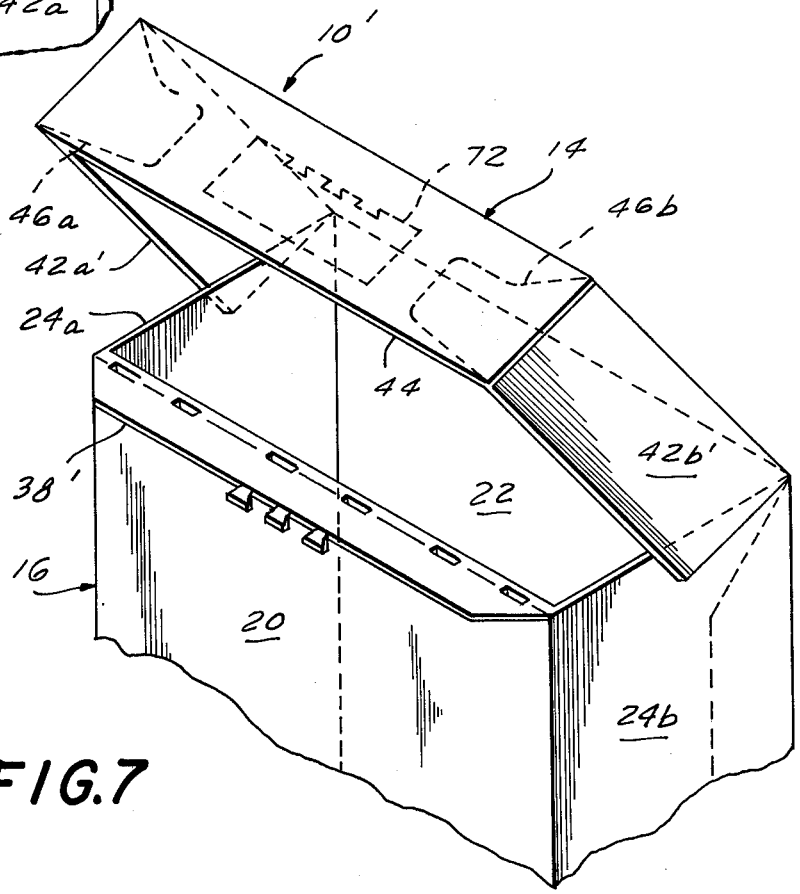

In order to appreciate the advantages of the present invention, an understanding of the prior art is required. Accordingly, FIG. 5 fragmentarily illustrates a pair of blanks 12' of the prior art while FIGS. 6 and 7 illustrate a carton 10' formed from such blanks 12'. The cartons 10 and 10' and blanks 12 and 12' are identical in all respects except for the following: The side cover panels 42*a'* and 42*b'* lack any equivalent of the line of severance 55, have no adhesive areas 60, and are at no time adhered to the side receptacle panels 24*a* and 24*b*. Instead of a spaced pair of tabs 38*a* and 38*b*, a single lip 38' extends the length of the front cover panel 20 and is connected by a line of severance 70 to a flap 72. The flap 72 is adhered to the inner surface of the front cover panel 44 intermediate the front cover flaps 46*a* and 46*b* by an adhesive area 74 on the inside surface of the front cover panel 44.

To initially open the carton 10', the line of severance 70 must be ruptured to separate flap 72 from lip 38'. When the carton 10' is reclosed, ledge 38' is engaged not only by the upper surfaces of flaps 46*a* and 46*b*, but also by the upper surface of flap 72, all such engagements acting to maintain carton 10' in its closed configuration.

Keeping in mind the aforegoing description of the prior art carton 10', it will be noted that the carton 10 of the present invention requires the use of less paperboard (or other material from which the carton is made) than the prior art carton 10'. While at first impression it might appear that the saving was only the small area of flap 72, a comparison of the layouts of FIG. 5 and FIG. 1 demonstrates that the actual saving in paperboard is actually the height of the flap 72 times the entire open width of the blank 12' due to the considerations involved in laying out a plurality of blanks on a single sheet of paperboard. Furthermore the carton 10 of the present invention requires the use of less glue or adhesive because the single large adhesive area 74 on front cover flap 44 is replaced by the two much smaller adhesive areas 60 on the side cover panels 42.

The carton 10 of the present invention is also easier to initially open then the prior art carton 10' because great leverage is obtained in opening the line of severance 55 of the carton 10 and essentially no leverage is obtainable in opening the line of severance 70 of the prior art carton 10'. The carton 10 of the present invention is also more consistently easier to open because there is no possibility of the adhesive areas 60 of the side cover panels 42 accidentally being misplaced (due to poor glue registration) and adhering the front cover panel 44 directly to the front receptacle panel 20. Finally, because the carton 10 of the present invention does not require the presence of any flap 72 intermediate the front cover panel 44 and the front receptacle panel 20, the carton 10 is less likely to develop an inwardly bowed front receptacle panel 20 which might impede compatability of the carton with automatic handling equipment.

Now that the preferred embodiments of the present invention have been shown and described in detail, various improvements and modifications thereon will become readily apparent to those skilled in the art. Accordingly, the spirit and scope of the present invention is to be limited only by the appended claims and not by the foregoing disclosure.

I claim:

1. A tamperproof reclosable carton formed of a suitably cut and scored blank having an open-topped receptacle portion and a cover portion which pivots to overlap the upper edges of said receptacle portion to close said receptacle portion; said carton being adapted to be filled with articles intermediate formation and closure of said receptacle portion;

(A) said receptacle portion comprising connected front, rear, bottom and a pair of opposed side receptacle panels connecting said front and rear receptacle panels, said front receptacle panel including at the top thereof a horizontally spaced pair of downwardly extending tabs overlying areas of the front surface thereof; and (B) said cover portion comprising:

(i) a top cover panel hingedly connected to the upper edge of said rear receptacle panel;

(ii) a pair of opposed side cover panels and a front cover panel, said side and front cover panels being connected to said top cover panel and forming skirt portions parallel and adjacent to the respective underlying receptacle panels; each of said side cover panels comprising a first panel portion connected to and depending from said top cover panel and a second locking panel portion connected to said first panel portion by a line of severance, each of said second locking panel portions overlying and being adhered to an associated one of said side receptacle panels, said cover portion being adhered to said receptacle portion exclusively by said locking panel portions; and (iii) the inner surface of said front cover panel defining upwardly facing ledges engaging the downwardly extending ends of said tabs when said cover portion overlaps said receptacle portion to close the latter.

2. The carton of claim 1 wherein said locking panel is connected to the remainder of said cover portion only by said line of severance.

3. The carton of claim 2 wherein said line of severance intersects the rear edge of said second locking panel at a point not above the junction of said top cover panel and said rear receptacle panel.

4. The carton of claim 1 wherein each of said second locking panel portions has the configuration of a right triangle and is detachably connected to its associated first panel portion only at the edge corresponding to the hypotenuse of said right triangle.

5. The carton of claim 1 wherein substantially the entire portion of said front receptacle panel intermediate said tabs and the overlying surface of said front cover panel are juxtaposed without any interposition.

6. The carton of claim 1 wherein said cover portion includes flaps connected to said side cover panels and adhered to the inner surface of said front cover panel to define said ledges.

7. A blank for forming a tamperproof reclosable carton having an open-topped receptacle portion and a cover portion which pivots to overlap the upper edges of said receptacle portion to close said receptacle portion, said carton being adapted to be filled with articles intermediate formation and closure of said receptacle portion, comprising:

(A) a receptacle portion having a front panel, a rear panel, a pair of opposed side panels connecting said front and rear receptacle panels, a bottom closure panel, and a horizontally spaced pair of tabs extending from a top edge of said front receptacle panel; and (B) a cover portion comprising a top panel connected to the top edge of said rear receptacle panel, a front panel connected to the top edge of said top cover panel, a pair of side panels, each of said side cover panels being connected along one of its side edges to a side edge of said top cover panel, flaps extending from the top edges of said side cover panels and adapted to be adhered behind said front cover panel and spaced from said top cover panel and each other to engage said tabs; each of said side cover panels having a readily severable line of weakness dividing the respective side cover panel into detachably connected front and rear segments, said front segment being connected along one of its edges to said front cover panel and said rear segment being adapted to be adhered to an adjacent one of said side receptacle panels.

8. The blank of claim 7 wherein said rear segment is connected to the remainder of said cover portion only by said line of weakness.

9. The blank of claim 8 wherein said line of weakness intersects the rear edge of said rear segment at a point not inwardly spaced from the junction of said top cover panel and said rear receptacle panel.

10. The blank of claim 7 wherein each of said rear segments has the configuration of a right triangle wherein the hypotenuse is coincident with one of said lines of weakness.

* * * * *